US005542650A

United States Patent [19]

Abel et al.

[11] Patent Number: 5,542,650

[45] Date of Patent: Aug. 6, 1996

[54] APPARATUS FOR AUTOMATICALLY CLEANING SMELT SPOUTS OF A CHEMICAL RECOVERY FURNACE

[75] Inventors: Clayton J. Abel, Beaverton; Greg Watson, Portland; Daniel R. Higgins, Tigard; Robert B. Hill, Beaverton, all of Oreg.

[73] Assignee: Anthony-Ross Company, Beaverton, Oreg.

[21] Appl. No.: 386,942

[22] Filed: Feb. 10, 1995

[51] Int. Cl.[6] ..... C21B 9/10

[52] U.S. Cl. ..... 266/135; 266/269; 266/271; 266/DIG. 1; 15/246

[58] Field of Search ..... 15/246; 266/DIG. 1, 266/271, 281, 269, 135

[56] References Cited

U.S. PATENT DOCUMENTS

| | | | |
|---|---|---|---|
| 2,391,443 | 12/1945 | Bruton | 202/241 |
| 2,535,932 | 12/1950 | Kemock | 266/271 |
| 3,025,548 | 3/1962 | Benkenstein | 15/104.16 |
| 4,277,312 | 7/1981 | McKenna et al. | 202/241 |
| 4,706,324 | 11/1987 | Goodspeed | 266/269 |
| 4,871,211 | 10/1989 | Aussel | 266/281 |

FOREIGN PATENT DOCUMENTS

| | | | |
|---|---|---|---|
| 2685653 | 7/1993 | France | 266/DIG. 1 |
| 3028313 | 2/1991 | Japan | 266/DIG. 1 |

*Primary Examiner*—Scott Kastler
*Attorney, Agent, or Firm*—Dellett and Walters

[57] ABSTRACT

A smelt spout cleaner apparatus includes a cleaning head insertable into a smelt spout and movable in a substantially linear path along the smelt spout for thoroughly cleaning the spout. The cleaning head is mounted on one end of a substantially horizontal beam, the opposite end of which is supported in cantilever fashion to a support base which is selectably movable. The support base includes means for longitudinally translating the beam and causing the cleaning head to move in a linear path along the length of the smelt spout.

36 Claims, 11 Drawing Sheets

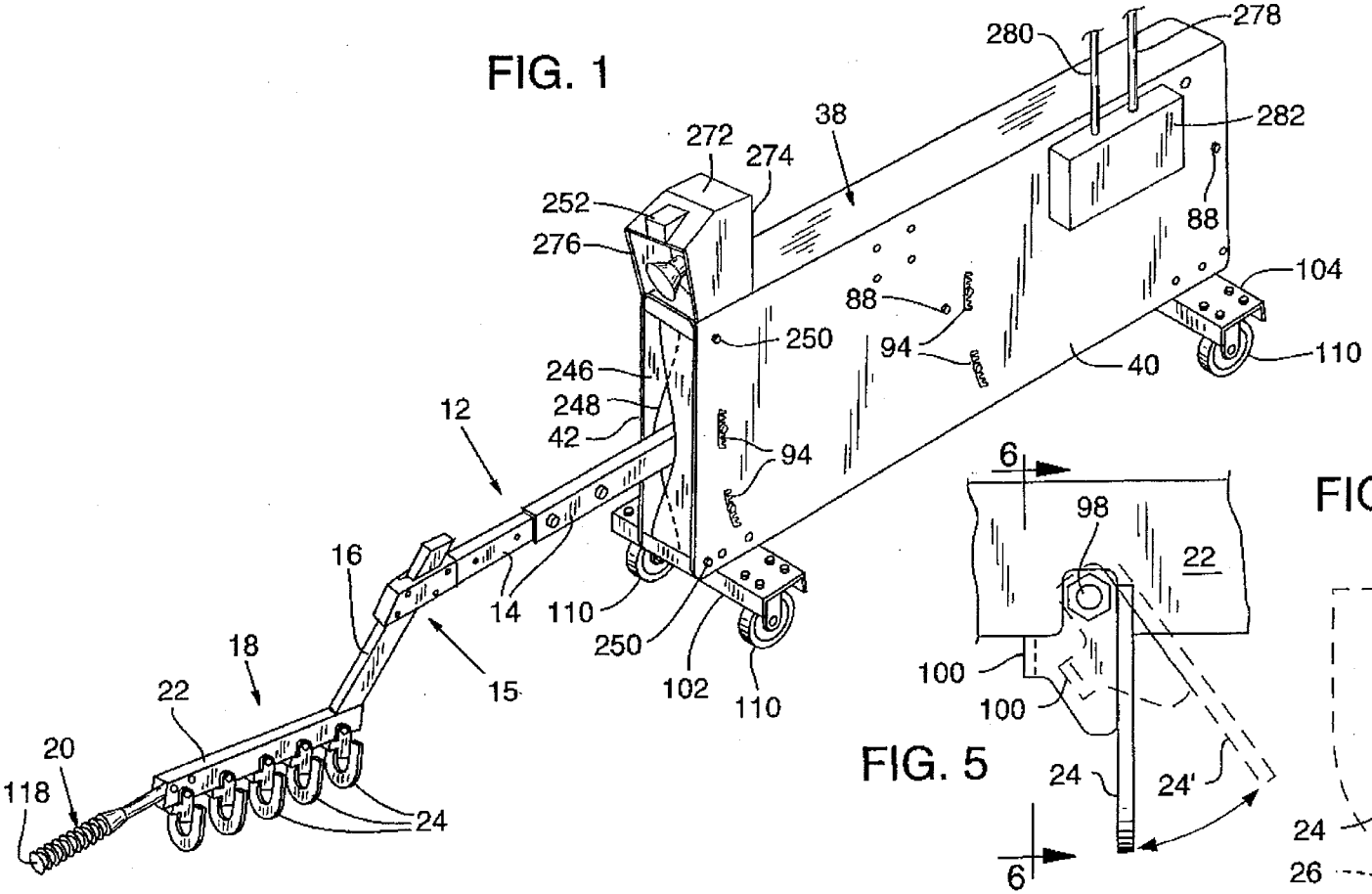
FIG. 1
FIG. 5
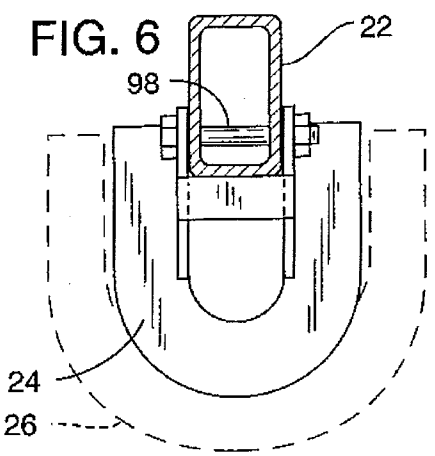
FIG. 6

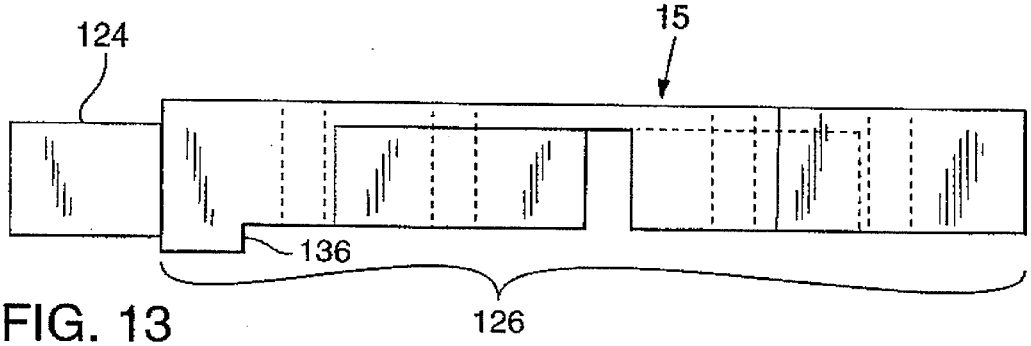
FIG. 13
FIG. 14
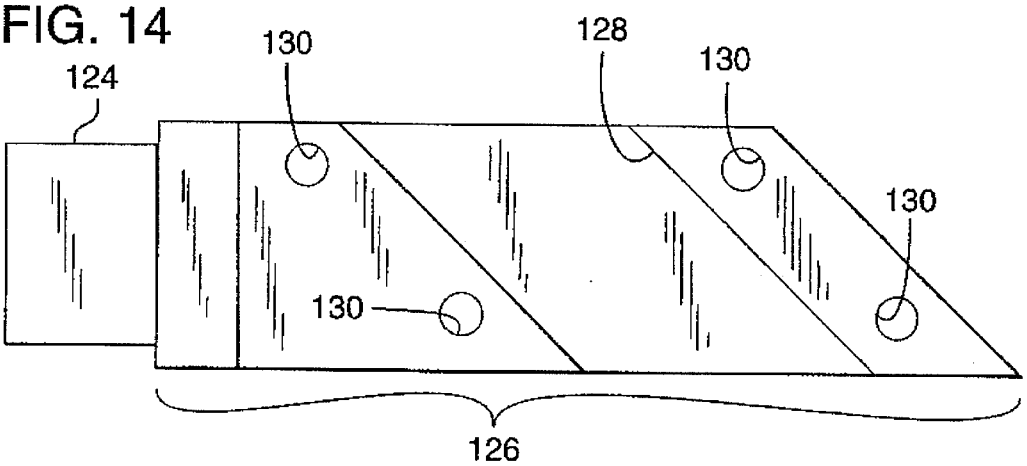
FIG. 15
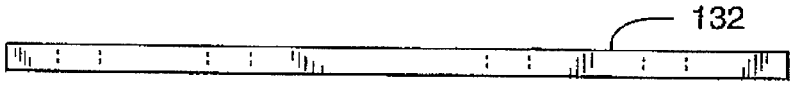
FIG. 16
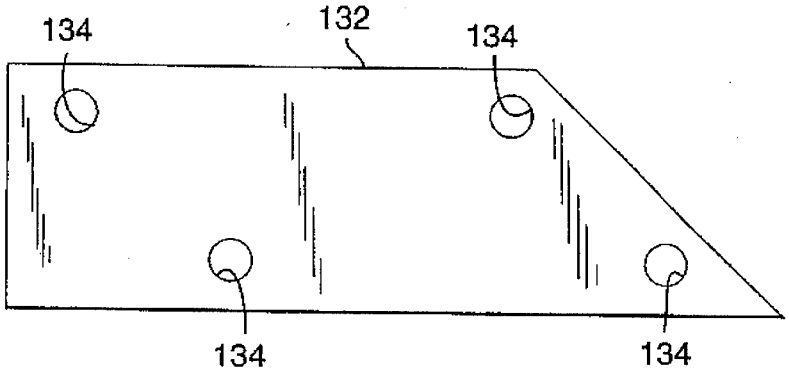

APPARATUS FOR AUTOMATICALLY CLEANING SMELT SPOUTS OF A CHEMICAL RECOVERY FURNACE

BACKGROUND OF THE INVENTION

The present invention relates to furnaces and particularly to apparatus for automatically cleaning spouts that drain molten chemical-containing smelt from the fire box of a chemical recovery furnace.

Wood pulp for paper making is usually manufactured according to the sulfate process wherein wood chips are treated with a cooking liquor including sodium sulfide and sodium hydroxide. The wood chips in the cooking liquor, called "white liquor", are cooked in a digester under predetermined heat and temperature conditions. After cooking, the used liquor, termed "black liquor", containing spent cooking chemicals and soluble residue from the cook, is washed out of the pulp and treated in a recovery unit where the cooking chemicals are refined. Without reclamation and reuse of the cooking chemicals, the cost of the paper-making process would be prohibitive.

In the recovery process, the black liquor is first concentrated by evaporation to a water solution containing about 65 percent solids, which solution is then sprayed into the fire box of a black liquor recovery boiler, a type of chemical reduction furnace. The chemical reduction furnace is a reactor wherein the processes of evaporation, gasification, pyrolysis, oxidation and reduction all occur interdependently during recovery of the cooking chemicals. The organic materials in the black liquor, lignin and other wood extracts, maintain combustion in the fire box, and the heat produced reduces the spent cooking chemicals. A molten smelt flows out of the furnace through a smelt spout to a collection tank. Concurrently, combustion heat is employed to generate steam in a wall of boiler tubes for use as process steam and for generating electricity.

Smelt spouts are designed to drain the smelt from the furnace, and keep the molten smelt within the furnace at a safe level. If a smelt spout is not cleaned periodically, the smelt freezes and forms a crust which will, in time, clog the smelt spout. Clogged smelt spouts can cause the level of smelt inside the furnace to rise, resulting in inefficient and unpredictable furnace operation with an attendant decrease in the amount of chemicals that can be recovered, a decrease in the amount of steam produced per unit of fuel, and increased emission of noxious gases such as carbon monoxide and sulfur dioxide. Moreover, the smelt can build up to a dangerous level and either block furnace air ports, potentially causing the fire to be extinguished, or fill up the furnace windbox, causing serious corrosion problems or even causing smelt to pour out onto the floor adjacent the furnace.

Smelt spouts of chemical recovery furnaces are cleaned manually by a worker inserting a long metal rod into the spout. Vigorous lateral and reciprocating movement of the rod by the worker dislodges char and encrusted material that may be clogging the spout. However, such manual rodding of the smelt spout is inefficient and unsafe and is a tedious, physically demanding job that fatigues operators, which can lead to impaired judgment and reaction time. Shoulder and arm injuries can result from the repeated vigorous motion needed to clean the smelt spout. It is increasingly difficult to find workers to perform such dangerous and demanding tasks.

The temperature of the smelt is 800° to 1000° C., and although the rods utilized to clean the spouts may be in excess of six meters long, there is a danger that a worker who manually rods the smelt spout can be burned if the negative draft of the furnace is lost and flames and/or smelt are emitted from the spout opening. Large pieces of slag inside the furnace can fall and cause the smelt to splash and injure a worker. Smelt spout openings are cooled by water circulating in a jacket surrounding the spout and such water jacket can become ruptured by improper rodding. A broken water jacket can result in an explosion in the furnace.

Other dangers to workers include the potentially hazardous fumes from the collection tank. The above noted attributes of chemical recovery furnaces make it desirable to minimize the amount of time during which workers are near the furnace and exposed to such hazards.

Apparatus for cleaning air ports in a recovery furnace is known, for example as set forth in U.S. Pat. No. 4,423,533 issued Jan. 3, 1984 and assigned to the assignee of the present invention. However, such apparatus is not suitable for cleaning of smelt spouts.

According to U.S. Pat. No. 4,706,324 issued Nov. 17, 1987, also assigned to the assignee of the present invention, a smelt spout cleaner is provided which is mounted upon the smelt spout or immediately thereabove on duct work leading to furnace air ports. Although this equipment has been found very satisfactory, the position thereof in straddling relation to the smelt spout shortens the expected life of the cleaning apparatus not only because of the temperature and splashed smelt, but also as a result of highly corrosive fumes emitted from the "green liquor" tank located below the smelt spout and receiving the smelt spout stream. Even if equipment is plated or powder coated, the corrosive fumes still attack and destroy non-wear parts. Moreover, the apparatus of the +324 patent moves the cleaning head assembly in an arcuate path from a location immediately above the smelt spout down into the smelt spout as suspended via pairs of pivoting arms. Only a relatively short length of the linear smelt spout is completely cleaned on this arcuate path even though some "give" is provided for cleaning head movement by slots in the pivoting arms.

Moreover, even though the cleaner of U.S. Pat. 4,706,324 is manually removable from the smelt spout, as a practical matter such removal must be accomplished at times when the furnace is shut down in view of danger to personnel. Thus, a new smelt spout cleaner cannot be installed, repaired or relocated quickly when the furnace is "on-line". Different furnace operating conditions can lead to different spout cleaning requirements, but the above noted safety concerns do not allow changes to the cleaner with the furnace on-line. Furthermore, the intimate mounting of the smelt spout on the furnace structure requires custom design for each new furnace installation, given the variation in construction between boilers in the design and location of primary air ducts, steam lines, cat walks and other equipment customarily located above the smelt spout.

Summary of the Invention

It is accordingly an object of the present invention to provide an improved smelt spout cleaner apparatus that is completely automatic and does not necessitate the attendance of personnel when the furnace is on-line.

It is another object of the present invention to provide an improved smelt spout cleaner for a chemical recovery furnace, said cleaner having an operating mechanism that is relatively isolated from the heat and vapor of the smelt.

It is another object of the present invention to provide an improved smelt spout cleaner that does not require custom design for each particular installation.

It is a further object of the present invention to provide an improved smelt spout cleaner having a long stroke for completely cleaning a smelt spout, i.e., for reaching farther into the furnace than is the case for a swingable device, and for accommodating different smelt spout mounting angles.

It is another object of the present invention to provide an improved smelt spout cleaner that enables changing of cleaning attachments to accommodate a variety of furnace operating conditions.

It is another object of the present invention to provide an improved smelt spout cleaner that eliminates or minimizes contact with the spout during a cleaning cycle.

It is another object of the present invention to provide an improved smelt spout cleaner that is adapted to also clean the furnace opening.

It is an additional object of the present invention to provide an improved smelt spout cleaner that is easy to install, service, and remove from operation without requiring special tools and without requiring the exposure of personnel to dangerous conditions.

It is an additional object of the present invention to provide an improved smelt spout cleaner that will sense misalignment between the cleaner and the spout.

It is another object of the present invention to provide an improved smelt spout cleaner that senses thermal expansion of the furnace and attendant movement of the spout during operation.

In accordance with the present invention, a smelt spout cleaner apparatus comprises a cleaning head insertable into a smelt spout and movable in a substantially linear path along the smelt spout for thoroughly cleaning the spout. The cleaning head is mounted on one end of a substantially horizontal beam, the opposite end of which is supported in cantilever fashion to a support base which is selectably movable. The support base includes means for longitudinally translating the beam and causing the cleaning head to move in a linear path along the length of the smelt spout.

In accordance with a preferred embodiment, the means for longitudinally translating the aforementioned beam comprises a camming track along which the beam travels, wherein the camming track is angularly disposed in parallel relation to the smelt spout for directing movement of the cleaning head along the smelt spout. Furthermore, the camming track is rotatable with respect to the support base in order to accommodate different smelt spout angles so as to conveniently adjust to a given smelt spout installation and whereby, when the apparatus is transported to a smelt spout having a different angle, the camming track is rotatably positionable to an attitude in parallel relation with the new smelt spout.

As a consequence of the present construction, several relatively standard support bases can be employed in various installations and the smelt spout cleaner can be deployed while the furnace is "on-line". The operating mechanism is located remotely from the heat and vapor of the furnace. Since the smelt spout cleaning head is translated for some distance along the length of the smelt spout, the spout is thoroughly cleaned and is therefore less apt to become dangerously clogged. For the most part, the smelt spout apparatus is completely automatic requiring no human intervention.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements.

DRAWINGS

FIG. 1 is a perspective view of smelt spout cleaning apparatus according to the present invention;

FIG. 5 is a broken-away side view of a rotatable cleaning paddle;

FIG. 6 is a cross sectional view taken at 6—6 in FIG. 5;

FIGS. 13, 14, 15 and 16 illustrate an attachment member for allowing attachment and removal of different cleaning heads;

DETAILED DESCRIPTION

Figures 2, 4:
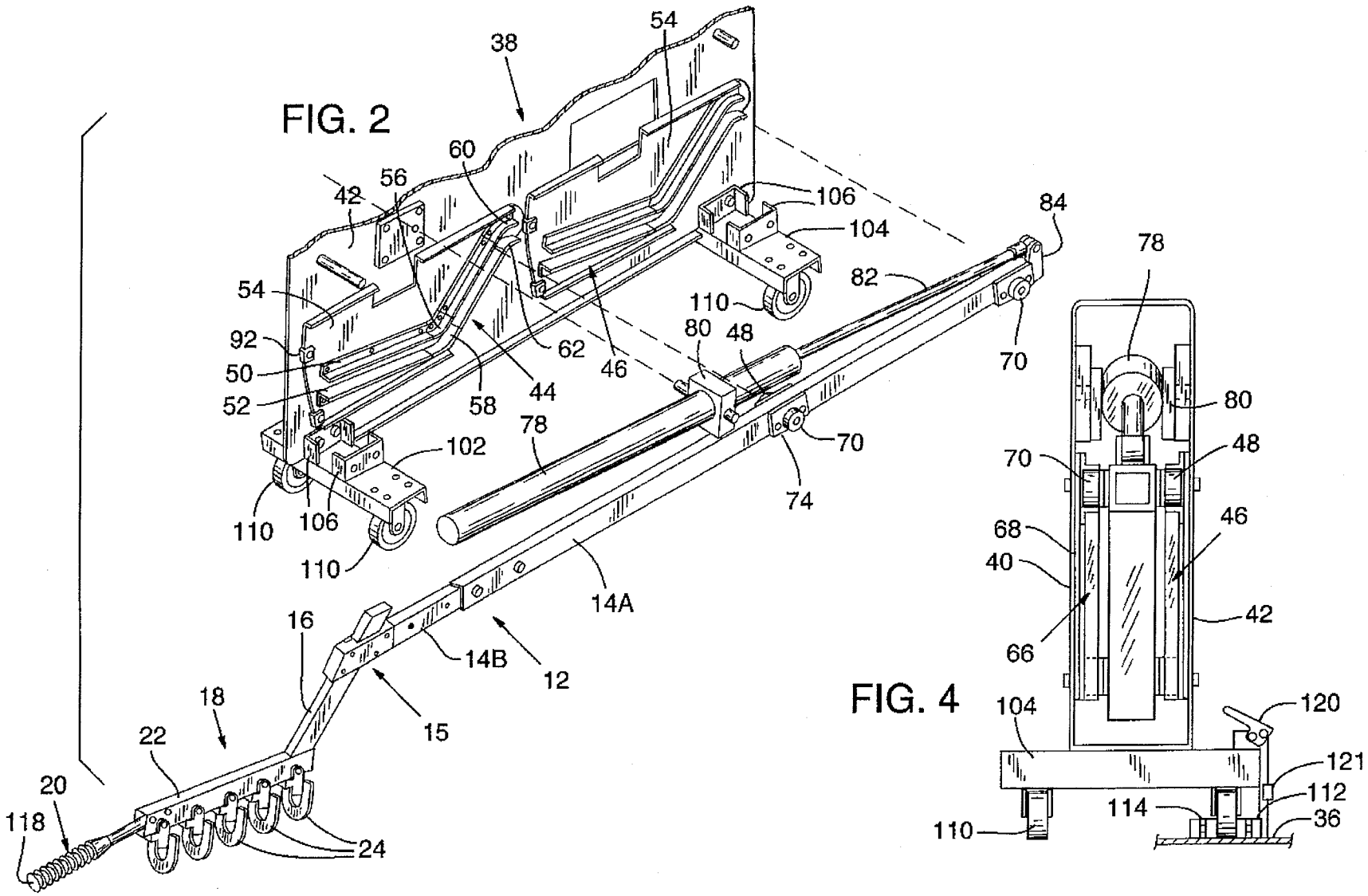
FIG. 2 is a partially broken-away and exploded view of the same apparatus.
FIG. 4 is an end view of the apparatus taken at 4—4 in FIG. 3.

Referring to the drawings, apparatus for automatically cleaning a smelt spout of a chemical recovery furnace comprises a traveling beam 12 having a substantially horizontal portion 14 and a forward portion 16 extending angularly downwardly from the horizontal portion 14. Portion 16 is secured to portion 14 via securement member 15, described hereinbelow with reference to FIGS. 13–16. Portion 16 supports a cleaning head assembly 18 at its lower extremity. Cleaning head assembly 18 suitably includes a cleaning tip 20 mounted on the forward end of a carrier 22, the latter also pivotally engaging a plurality of spout channel scraping members or paddles 24. Cleaning head assembly 18, as joined to beam portion 16, is adapted for insertion into smelt spout 26, wherein such spout 26 slants downwardly from an opening of chemical recovery furnace 28 so as to pour smelt from the furnace. The furnace is equipped with a plurality of smelt spouts as well as a plurality of air ports 30 thereabove for receiving combustion air under pressure from duct 32.

The smelt spout 26 is located within a "dog house" or protective cover 34 forming the upper portion of a large "green liquor" tank into which smelt flowing from smelt spout 26 is decanted. The operating floor 36 in front of the furnace is formed of steel or concrete and is located above the tank or tanks containing the green liquor.

A support base 38 for beam 12 comprises a housing including parallel, spaced, vertical side panels 40 and 42, each side panel carrying a pair of camming guide means taking the form of camming tracks mounted on the inner side of a panel disposed in facing relation to similar tracks on the opposite panel. The camming tracks on the juxtaposed panels are aligned to receive cam follower rollers therewithin, said rollers being mounted on sides of beam portion 14.

Each of the camming tracks, for example, camming track 44 in FIG. 2 mounted on panel 42, is comprised of vertically spaced apart, parallel angle members 50 and 52 adapted for receiving roller 48 therebetween. Track members 50 and 52 are secured to the inside of a movable plate 54 that is in turn attached to panel 42 in the manner hereinafter more fully described. Track members 50 and 52 are canted forwardly and upwardly at left end of support base 38 as viewed in FIG. 2. The track members 50 and 52 are thus disposed at an angle with respect to the horizontal, approximately at the same angle as smelt spout 26.

The rearward portions of camming track members 50 and 52 are canted upwardly and rearwardly as depicted in FIG. 2. The forward and rearward sections of the track members 50 and 52 are centrally joined via curved sections 56 and 58 that maintain a spacing suitable for passing roller 48.

The linear forward portion of camming track 44 is angled forwardly and upwardly in order to cause the cleaning head assembly 18 to move in a path parallel to the bottom of smelt spout 26, while the rearward track portion is adapted to move the cleaning head assembly 18 upwardly from the smelt spout and toward an at-rest or home position. The at-rest or home position is defined between extreme upper camming track sections 60 and 62 at the right end of camming track 44 in FIG. 2. Sections 60 and 62 curve past the horizontal to an "over-center" position where the track curves slightly downwardly and to the right. Roller 48 is supported in the extreme right hand end home position so it will not roll down the track to the left, unless positively translated in that direction. Camming track 46 is identical in construction to camming track 44 and is adapted to receive a second roller 48 located rearwardly (to the right in FIG. 2) along beam 12 from the first mentioned roller.

Figure 7A:
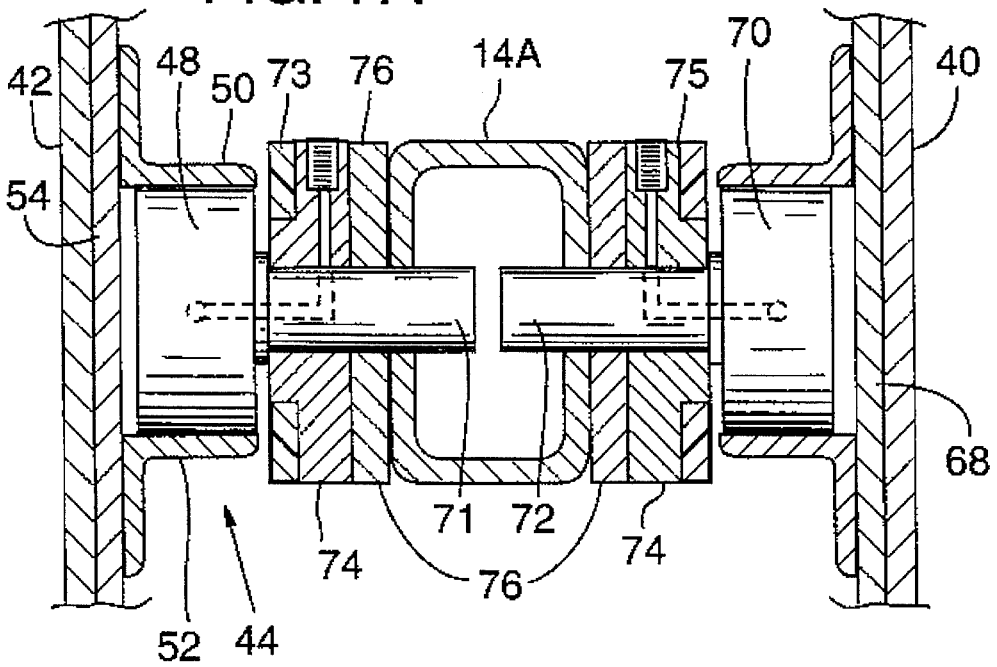
FIG. 7A is a cross section of a cam roller assembly utilized with the present apparatus.
Figure 7B:
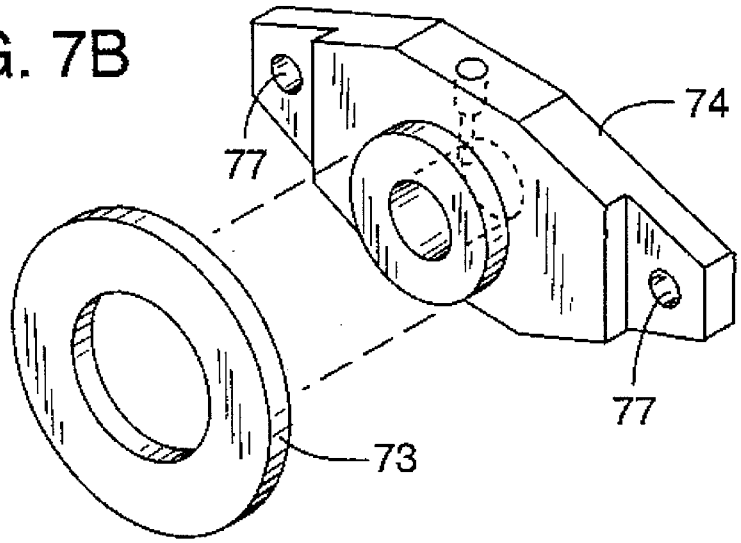
FIG. 7B is a perspective view of the cam roller mount and track disk portion of FIG. 7A.

As previously indicated, camming tracks 44 and 46 have mirror image counterparts 64 and 66, respectively, which are carried by panel 40 and in particular by plates 68 that are attached to panel 40 in a manner hereinafter more fully described. The tracks 64 and 66 receive rollers 70 mounted on sides of beam portion 14 in coaxial relation to rollers 48. Mounting of the rollers is depicted in more detailed fashion in FIGS. 7A and 7B wherein it is seen the rollers are journalled on ends of shafts 71 and 72, wherein each shaft is mounted by threaded engagement with beam portion 14A by way of side mounting plates 74 secured to beam portion 14A via spacers 76 and a pair of bolts (not shown) that pass through apertures 77 formed near opposing edges of the plate. Beam 14 carries corresponding apertures for receiving the bolts. A track disk 73, 75, suitably comprising a synthetic resin polymer such as Teflon, engages each plate 74 and provides a wear surface against which the cam tracks may wear. Openings are provided in plate 74 to enable lubrication of rollers 48 and 70.

It will be seen the cleaning head assembly 18 is supported in cantilever fashion at some distance from support base 38 by virtue of the intervening extent of traveling beam 12. The weight of the traveling beam and cleaning head assembly 18 is carried by rollers 48 and 70 riding along the tracks 44, 46, 64 and 66 that guide the traveling beam and cleaning head assembly in a predetermined path. Thus, as a roller 48 traverses between track members 50 and 52, forwardly of curved sections 56 and 58, the cleaning head assembly 18 moves directly along the extended length of smelt spout 26, assuming the tracks 44, 46, 64 and 66 are oriented so that their forward sections are parallel the smelt spout, and assuming the apparatus is in direct juxtaposition with the spout. After forward movement of the traveling beam 12, the beam is withdrawn causing its supporting rollers, for example roller 48, to traverse rearward sections of the track toward the home position. The cleaning head assembly 18 is thereby upraised away from the smelt spout, typically about eight inches above the spout in the vicinity of the entrance of "dog house" 34.

To bring about reciprocating movement of the beam 12, an actuating means suitably in the form of a pneumatic cylinder 78 is pivotally mounted via trunnion 80 between side panels 40 and 42 of support base 38 proximate the forward end thereof. Rod 82 of the cylinder is pivotally connected by rod eye 84 to the upper surface of beam portion 14A, between the respective cam rollers. As the pneumatic cylinder is actuated to retract rod 82, the cam rollers 48, 70 move from the home position along the aligned tracks, first lowering the cleaning head assembly 18 toward the smelt spout, and then moving the cleaning head assembly directly along the length of the smelt spout. (See the dashed-line position of the cleaning head assembly at 18' in FIG. 3.) The cleaning head assembly is then withdrawn by the extension of rod 82 by operation of actuator 78 in the reverse direction. The configuration wherein rod 82 extends when withdrawing the cleaning head assembly provides maximum mechanical advantage on the withdraw stroke, which may be desirable in situations where smelt is firmly encrusted in the spout or furnace opening.

It will be seen that disposition of respective identical tracks, e.g. tracks 44 and 46 at forward and rearward locations at the same level, causes beam portion 14 to maintain a substantially horizontal attitude. The weight of the cantilevered cleaning head assembly 18 urges the forward cam rollers toward the lower track members, for example track member 52 in FIG. 2. Therefore, in an alternative version of the present apparatus, track member 50 is eliminated enabling cleaning head assembly 18 to ride up over material in the smelt spout when the smelt spout is clogged. For most purposes, however, the embodiment as shown, having tracks comprised of upper and lower track members 50 and 52, is preferred.

For matching the angle of the respective tracks to the angle of the smelt spout, the tracks 44, 46, 64 and 66 are angularly adjustable. Each of tracks 44, 46, 64 and 66 is attached, as by riveting, to a track adjusting plate 54 or 68 that is in turn pivotally mounted with respect to side panels 40 and 42.

Figure 8:
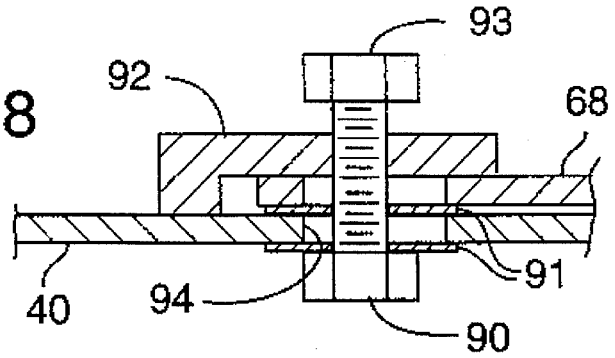
FIG. 8 is a cross section illustrating adjustment means for cam tracks of the subject apparatus.
Figure 9:
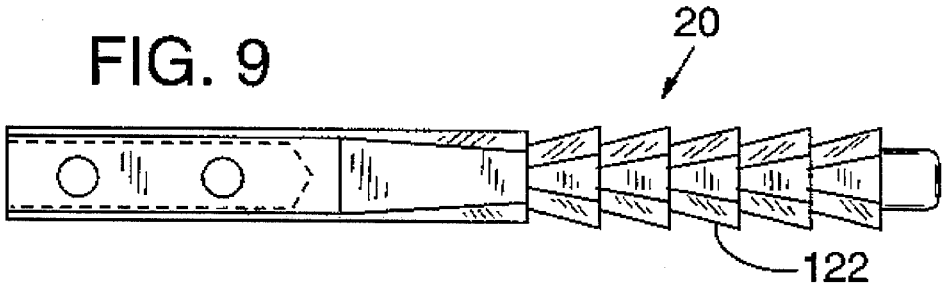
FIGS. 9, 10, 11 and 12 depict a cleaning tip utilized with the subject apparatus.
Figure 10:
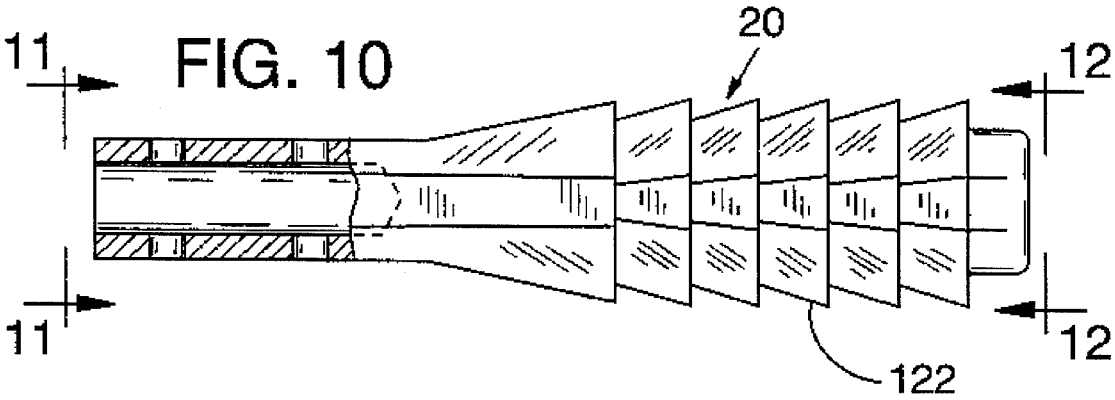
Figure 11:
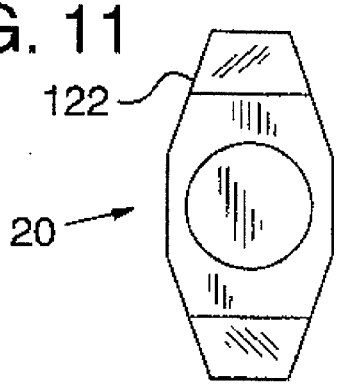
Figure 12:
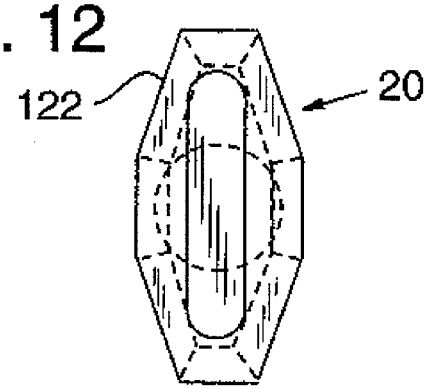

Specifically, a first end of each plate 54, 68, the end farthest from the cleaning head assembly, is attached to a side panel by means of a bolt 88, while the remaining or forward end of each plate 54, 68 is secured to the same panel employing a pair of bolts 90 each adapted to engage a somewhat "L" shaped threaded member 92 that is adapted to engage the plates 54, 68 at the front edges thereof. A pair of washers 91 are interposed between the head of bolt 90 and panel 40 and between panel 40 and plate 54 or 68. A lock nut 93 is attached to the distal end of the bolt, with threaded member 92 disposed between lock nut 93 and the inner face of plate 54 or 68. The side panel, e.g. panel 40, is provided with arcuate shaped slots 94 of variable width defining a number of fingers 96 (see FIG. 8) between which the shank of a bolt 90 is received. To adjust the positioning of a plate 54, 68, bolts 90 are loosened to enable disengagement with slots 94 and the plate is rotated about fastener 88 until a proper angle for the track is achieved. Then the bolts 90 are positioned at the forward edge of plate 54, 68 at a proper location between fingers 96 for securing the plate in place. Upon tightening of the bolt, the leg of "L" shaped threaded member 92 will engage the lower edge of plate 54, 68, preventing undesired rotation of member 92. Of course, each of the plates 54 is adjusted to the same angle in order to maintain the horizontal attitude of beam 12. Lock nut 93 provides a stop which prevents member 92 from falling off the end of the bolt as a result of over loosening bolt 90.

Beam portion 14 is advantageously formed from telescoped sections, 14A and 14B as depicted in FIG. 2. The adjustment facilitates proper positioning of cleaning head assembly 18.

Turning now to FIGS. 5 and 6, scraping members or paddles 24 are illustrated in greater detail. The paddles are mounted at spaced locations along carrier 22 and are pivotally supported via bolts 98 passing through carrier 22. A stop member 100 is secured to the forward side of the paddle for limiting rotation in a clockwise direction (as viewed in FIG. 5) whereby the paddles perform a scraping or cleaning action when withdrawn along smelt spout 26. However, when the cleaning head assembly is moved inwardly directly along the length of the smelt spout, the paddles can rotate rearwardly as indicated by dashed lines at 24' in FIG. 5 whereby to ride up and over encrusted material in the smelt spout. The rearward rotation of the paddles reduces splatter and splashing of the smelt during the insertion stroke. Without the rotation movement, the potential exists for smelt to be pushed over the edges of the smelt spout during the insertion stroke.

In order to provide further protection for the components at the interior of support base 38 from the environment in the neighborhood of the recovery furnace, a front screen 246 (FIG. 1) is provided which forms an opening 248 to enable beam 12 to extend through the screen. The screen suitably comprises two pieces of polished fiber glass fabric, each piece having a relatively straight edge and a curved edge, wherein the two pieces of fabric are placed over one another with their curved edges facing opposite directions and the two pieces are sewn together. The pieces of fabric are sewn so as to provide a loop portion at each end to enable a retainer bar 250 to slide through the loop so as to maintain the screen in close engagement with support base 38. The arrangement of the fabric enables the beam to move upwardly and downwardly as well as inwardly and outwardly while providing a physical barrier to minimize entry of contaminants and the like into the interior of base 38.

The support base 38 in the illustrated embodiment is carried by forward and rearward trucks, 102 and 104, each provided with brackets 106 welded to an upper surface thereof. Side panels 40 and 42 are secured to the brackets 106 whereby the side panels are maintained in an upright position. Outer ends of trucks 102 and 104 are equipped with wheels 110 that permit the apparatus to be moved from place to place, and to be aligned accurately in front of a smelt spout. The floor 36 is suitably provided with chocks 112 for locating the wheels 110 whereby the cleaning head assembly will accurately traverse the smelt spout 26, moving along the length thereof. Chocks 112 may include side members 114 completing a "pocket" to receive the wheels 110. Each of trucks 102 and 104 also may carry clamps 120 (FIG. 4) at the distal ends of each truck. The floor, in conjunction with chocks 112, may include a corresponding latch plate 121 which is adapted to be engaged by the clamp. Accordingly, when the wheels 110 are appropriately positioned, each of the clamps may be operated to engage the latch member whereby the support base is secured in position and not subject to unintended movement. Clamp 120 is suitably of a type to provide a pulling action perpendicular to the base and in a preferred embodiment comprises "DE-STA-CO." brand Model 324 clamps. The latch includes a threaded U-bolt bail member which through adjustments of nuts on the threads is easily adapted to provide a positive engagement with the latch plate.

Figure 3:
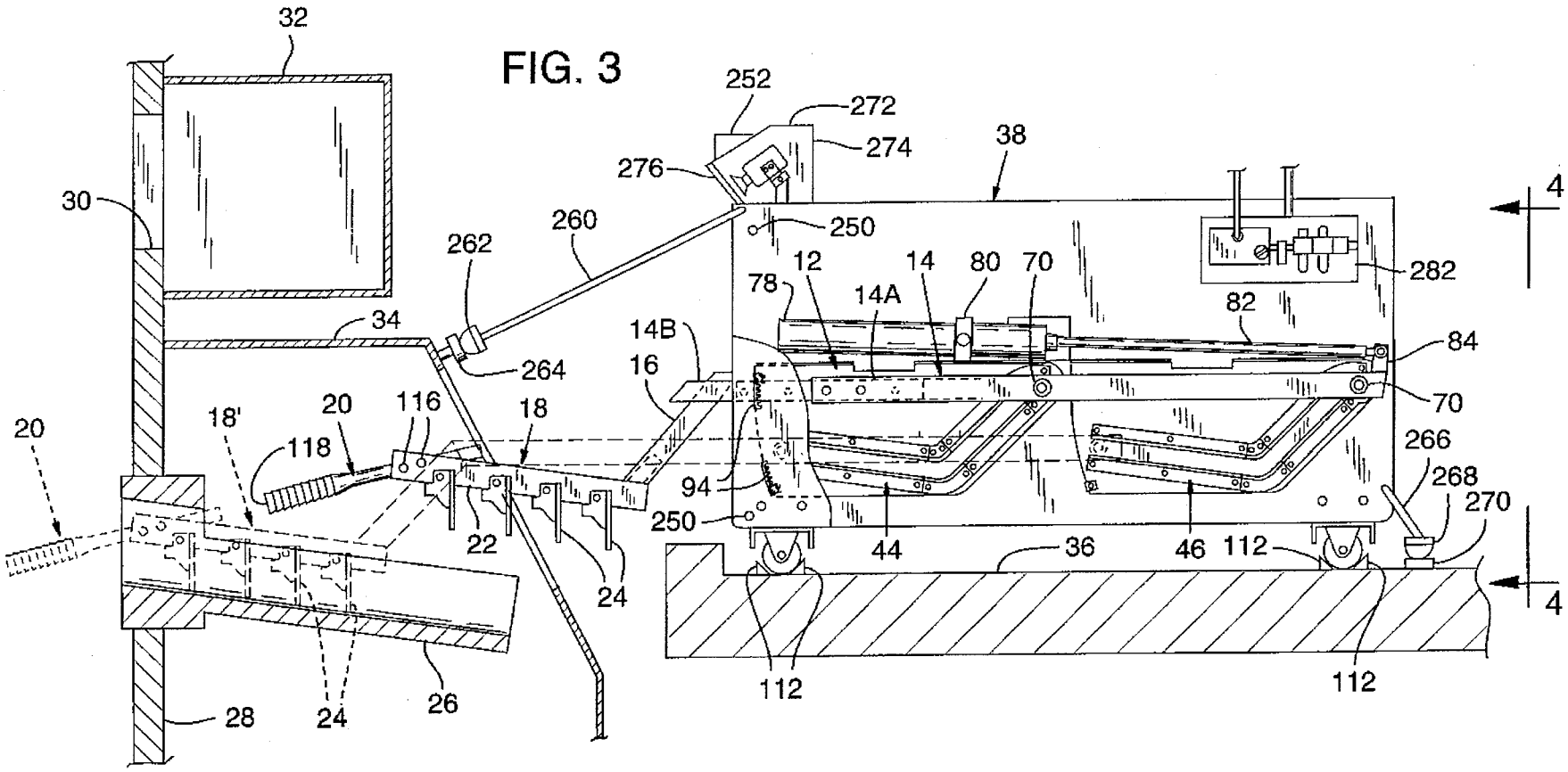
FIG. 3 is a partially broken-away side view of the smelt spout cleaning apparatus together with a portion of a chemical recovery furnace with which the apparatus is employed.

FIGS. 9–12 further illustrate a cleaning tip 20 advantageously secured at the leading end of carrier 22 in the manner depicted in FIG. 3. The cleaning tip is attached to the carrier by means of fasteners 116 which dispose the cleaning tip in a position extending angularly downwardly from the carrier. The forward end 118 of the cleaning tip is suitably disposed on the same level as the lower extremity of paddles 24 so that when the cleaning head assembly 18 moves into the smelt spout 26, cleaning tip 20 can dislodge material from the smelt spout. The cleaning tip 20 as further illustrated in FIGS. 9–12 is an ASTM A297 HC steel member provided on its forward end with a plurality of tool-like teeth 122, serrated for pushing material ahead of the cleaning tip. The tip 20 is particularly advantageous for cleaning the opening between the furnace and the smelt spout. The cleaning head assembly 18 is replaceable with other tools, e.g. for heating encrusted smelt in the spout at a time after the furnace has been shut down. Also, the shape of paddles 24 may be changed to conform to the profile of a particular smelt spout.

The apparatus advantageously incorporates timing means for operating cylinder 78 and causing movement of beam 12 and correspondingly cleaning head assembly 18 on a periodic basis. In a typical cleaning mode, the cleaning head assembly will be moved forwardly into the smelt spout every 20 to 30 minutes during furnace operation. Several forward and rearward strokes will be performed wherein the forward stroke of the cleaning head assembly positions the assembly and also cleans the furnace opening. The rearward stroke pulls encrusted material downwardly along the spout. Repeated insertion and retraction stokes pull the material successively further down the spout in an iterative manner.

According to an alternative embodiment, the smelt spout cleaner apparatus is sensitive to vertical movement of the furnace itself. A target (not shown) disposed on the forward wall of the furnace is viewed by photoelectric sensing means 252, and as the furnace wall 28 moves upwardly or downwardly under extreme temperature conditions, the cleaning apparatus is disabled, or alternatively moved upwardly or downwardly with the furnace so as to be properly receivable in a smelt spout attached to the furnace wall. Sensor 252 suitably comprises a photoelectric sensor, for example a Maxi-Beam brand sensor sold by the Banner Engineering Corporation of Minneapolis, Minn.

Still further embodiments include apparatus to detect alignment of the cleaning head 18 to the smelt spout 26 and also to detect alignment of the cleaning apparatus to the wheel chocks and locking mechanism 112. As may be observed in FIG. 3, an extension arm 260 is attached forwardly of the support base 38 and extends towards dog house 34. At the end of extension arm distal from support 38 is a sensor or detector 262 which has a corresponding detection or sensed member 264 mounted to the dog house. The sensor/target combination 262, 264 may comprise a wobble head limit switch and location cup which employ mechanical interference or proximity sensor and corresponding metal locator disk, for example wherein the wobble head limit switch is a mechanical type sensor and the proximity sensor is a magnetic sensor which is adapted to indicate proximity to the metal locator disk 264. A photoelectric sensor and corresponding target are employed in an alternate embodiment. The proximity switch may suitably comprise a Turck inductive sensor, part No. B1-5-G18-AZ3X sold by Turck Inc. of Plymouth, Minn., while the wobble head limit switch suitably comprises a Cutler-Hammer limit switch, Model E50D02 manufactured by Cutler-Hammer of Houston, Tex. A similar extension arm and sensor/target combination 266, 268 and 270 may be advantageously employed at the rear of the cleaning apparatus wherein the extension arm mounts near the floor at the back of support base 38 so as to bring the sensor 266 into close engagement with locator 270. Locator 270 is positioned so as to provide an indication when the support base 38 is properly positioned within wheel chocks 112, so as to provide, for example, remote sensing to indicate that the smelt spout cleaning apparatus is or is not in its correct position for normal operation. Also provided is camera 272 mounted to support base 38 at the front end thereof wherein the camera is provided with a heat resistant protective cover portion 274 which includes front glass 276. The camera thereby provides a view towards dog house 34 to enable remote observation of the operation of the cleaner and the condition of the smelt spout. Air and electrical supply are provided via air line 278 and electrical line 280 (which may include return sensing lines) to provide air and electrical power for operation of the various components of the cleaning apparatus. A control panel access door 282 enables access to internal controls which may include on and off controls and adjustment controls for automatic operation, including adjustment of frequency of cleaning strokes and the like.

As can be seen, the mechanism for bringing about forward and rearward movement of the cleaning head assembly is disposed at a distance from the smelt spout, outwardly away from the furnace, and therefore is less subject to breakdown because of high temperature conditions the entire apparatus can be removed from the area of the smelt spout without shutting down the furnace. The cleaning head assembly is adapted to clean the full length of a smelt spout and is adjustable so the cleaning head moves in a path parallel with and along the smelt spout. A standardized support base can be used for spout cleaners according to the present invention without the need for custom installation. The cooperation between the rotating paddles and the relatively short stroke length provided by the actuator provide an iterative cleaning operation wherein on each successive upward stroke, the paddles rotate rearwardly so as to ride up and over any encrusted material in the spout, but upon the retraction stroke the paddles securely engage and pull the material downwardly further down the spout with each successive stroke. Such an arrangement enables the use of an actuator having a relatively short stroke length reducing cost as well as space requirements. Multiple short strokes provide effective smelt spout cleaning and removal of material.

Referring now to FIGS. 13, 14, 15 and 16, the securement member 15 which is adapted to engage various interchangeable attachment members is shown. FIGS. 13 and 14 are top and side views respectively of a first portion of the attachment while FIGS. 15 and 16 are top and side views respectively of a securement plate portion of the attachment member. Referring to FIGS. 13 and 14, stub 124 fits within horizontal portion 14 (FIG. 1) and is securely held therewithin by any suitable means. An externally extending portion 126 comprises a diagonally oriented channel 128 and, in the illustrated embodiment, four securement holes 130. Referring to FIGS. 15 and 16, a securement plate 132 has securement holes 134 which are adapted to correspond and align with the holes 130 of FIGS. 13 and 14. In use, an arm portion of an attachment which is to be employed in conjunction with the smelt spout cleaner fits into slot 128 and attachment plate 132 is then placed against portion 126 and fits within mating channel portion 136 and is then securely fastened, for example, by bolts through holes 130 and 134 to thereby provide firm engagement between a securement plate and the body portion of channel 128 so as to tightly engage the particular attachment member.

Figure 17:
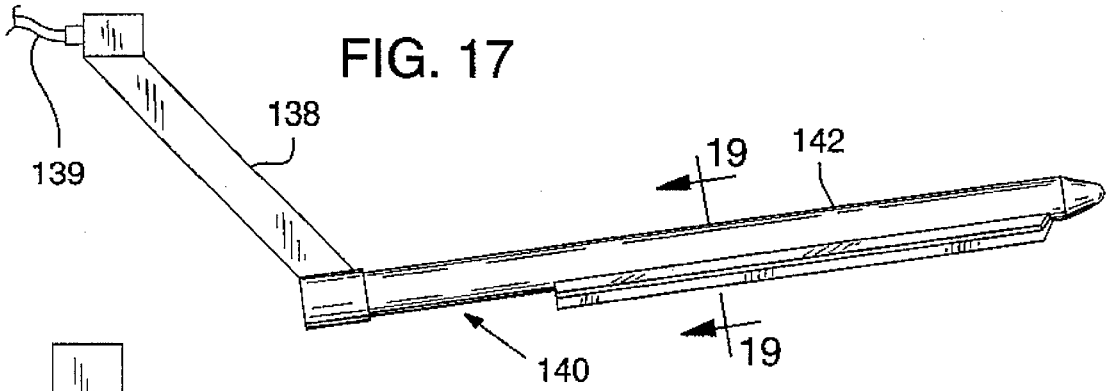
FIGS. 17, 18 and 19 depict an alternative attachment for use during boiler start up.
Figure 18:
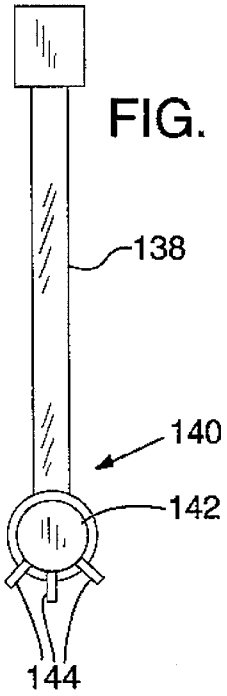

While one cleaning attachment suitable for use with the apparatus is shown in FIGS. 1–3 and 9–12, FIGS. 17–19 show an alternative cleaning attachment which comprises a heated element, suitable for use during, for example, boiler start up when liquor may be present and the smelt may be cold and therefore somewhat solidified and resistant to flow. Referring to FIG. 17, the heated tube attachment 140 comprises a support arm 138 adapted to fit within channel 128 of the attachment member of FIGS. 13–16. Mounted to member 138 is heated tube attachment 142, which is suitably of cone-shape at the leading edge thereof for insertion into the smelt spout. Electrical power is supplied by cable 139 for generation of heat, while temperature sensing may also be returned for temperature control as discussed hereinbelow. Referring to FIG. 17 together with and FIG. 18, which is an end view of the heated tube attachment, three fin members 144 are provided at the bottom of heated tube portion 142 and suitably enable the heated portion to be maintained a distance above the bottom of the smelt spout channel during use so as to transfer most of the generated heat to the smelt and not to the smelt spout.

Figure 19:
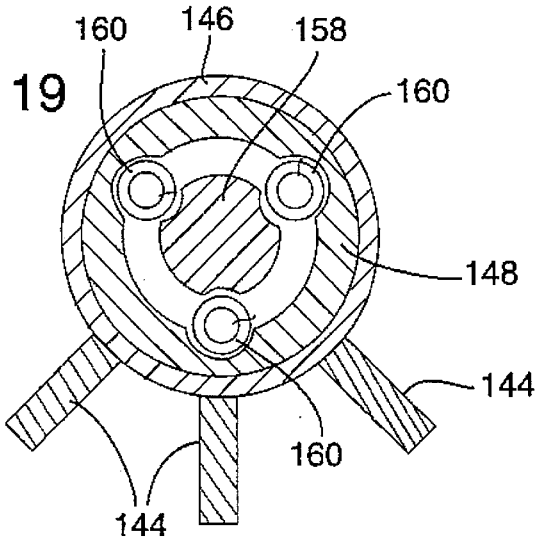
Figure 20:
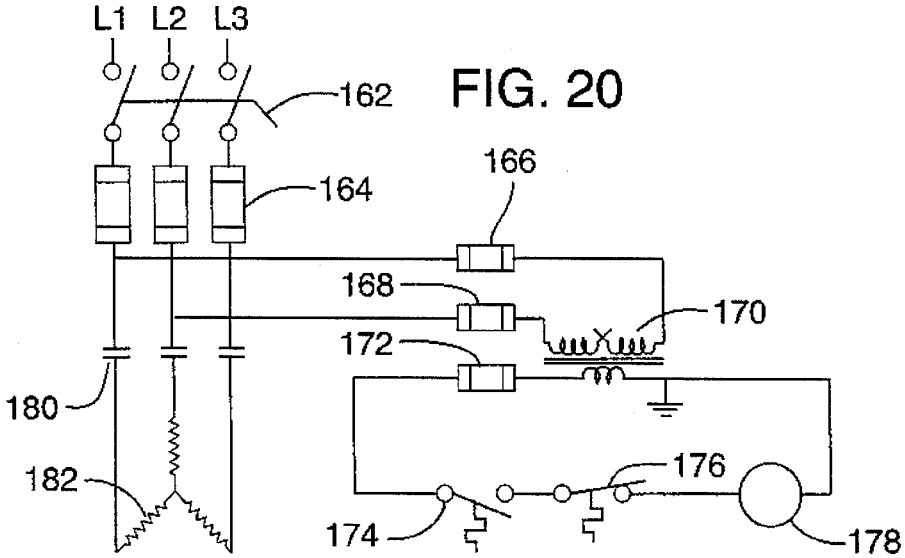
FIG. 20 illustrates the electrical circuit for the element of FIGS. 17–19.

FIG. 19 is a sectional view along lines A—A of FIG. 17, illustrating internal construction of the heated tube portion. The external wall of the heated tube portion 146 is suitably constructed of Inconel high-temperature alloy No. IN625 or similar alloy and surrounds an annular ceramic retainer 148. A central ceramic retainer 150 is substantially rod shaped and the two ceramic retainers define an annular space therebetween which receives three heating elements 160 in spaced arrangement therewithin. The heating elements suitably comprise A1 iron/chrome heating elements which are electrically heated. The circuitry for heating the elements is illustrated in FIG. 20 wherein electrical power, suitably 460 volt three-phase at 60 cycles, is supplied via disconnect 162. Each of the three power lines passes through a respective fuse 164 with the first and second lines supplied through fuses 166 and 168 to respective ends of the primary of control power transformer 170. The secondary of the control power transformer is grounded at one end and the second end of the transformer secondary is connected through a series circuit comprising fuse 172, temperature control switch 174 and high-limit switch 176, to a control coil 178.

A second leg of the control coil is grounded. The temperature control and high-limit control are operated in response to an electronic controller, for example a thermostat or thermocouple which determines the operating temperature of the heating tube attachment. The thermostat or thermocouple may suitably be contained within the interior of the heating element member. The three power lines are further provided through fuses 164 to control relays 180 which are normally open. The relays close when actuated by energization of control coil 178. Each of the control relays is further attached to one end of each of three heater elements 182, with the opposing ends of the three heater elements connected together.

In operation, when both temperature control switch and high-limit switch 174 and 176 are closed, control coil 178 is energized and causes relays 180 to close thereby providing power to the heater elements for generating heat. The heated tube is then sufficiently heated to allow melting of solidified smelt and when advanced, will enable a hole to be opened through the smelt into the interior of the boiler to allow drainage of the smelt to resume. The temperature is controlled by on/off operation of temperature switch 174 in response to a thermostat or thermocouple. Should the temperature exceed a high limit, switch 176 will open and disconnect power to the coil 178 thereby causing each of relays 180 to open and disconnect power from the heater elements. High-limit switch 176 provides additional protection in the event of failure of temperature control so that the unit is not destroyed by overheating.

Figure 22:
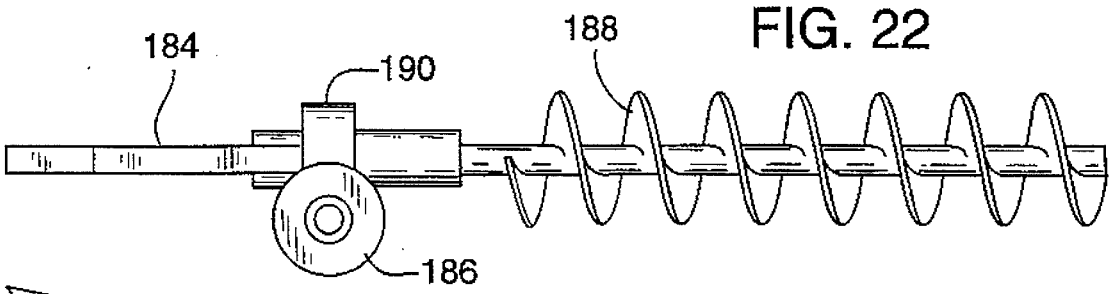
FIGS. 21, 22, 23 and 24 illustrate an auger attachment for use when smelt spout tunnel area plugging is unusually severe.
Figure 21:
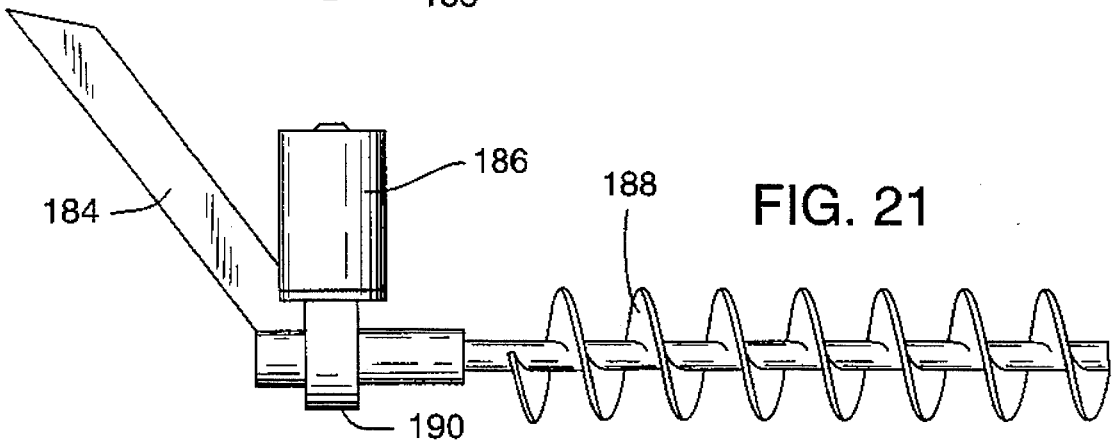
Figure 23:
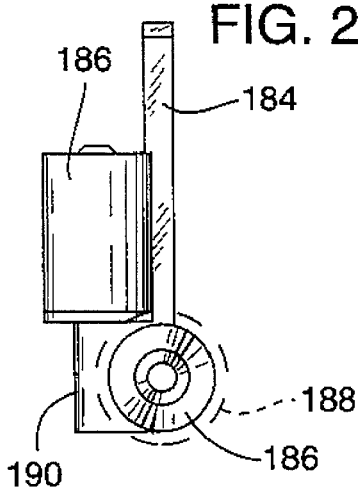
Figure 24:
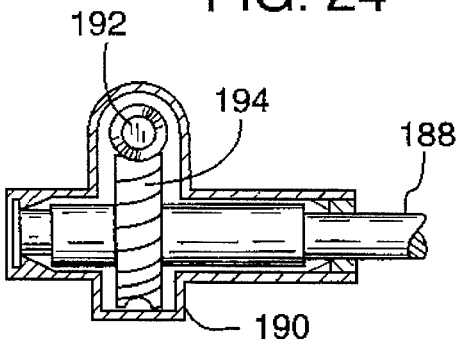

FIGS. 21–23 are side, top and end views respectively of an alternative cleaning attachment, comprising a powered auger adapted for use when the tunnel area between the smelt spout and the interior of the furnace is experiencing such a high rate of fouling that attachment 18 becomes ineffective. Under certain firing conditions, large pieces of somewhat solid material may be present within the smelt pool inside the furnace and may tend to block the opening to the smelt spout. Use of a poking type attachment may be ineffective at removing these pieces of material since the floating pieces will be pushed away from the opening back into the furnace only to return once the poking attachment is withdrawn. Accordingly, an auger attachment is provided that comprises an arm portion 184 which is adapted for engagement with the clamp member 15 of FIGS. 13–16. A motor 186 which suitably comprises an electric or air-powered motor mounts at the distal end of arm 184 and is in driving engagement with auger 188. The rotation of the motor is conveyed to the auger via a gear reduction portion 190 which is shown in cut-away view in FIG. 24 and which comprises a worm gear 192 which is driven by rotation of motor 186 and which meshes with gear 194 to rotate the auger 188. The gear housing 190 also suitably includes bearing members for enabling smooth rotation of the auger portion. The auger is inserted into the furnace opening and, when rotated, draws out the floating material as well as providing cleaning of the smelt spout.

In the above described embodiments, a certain amount of deck space is presumed to be available to allow movement of the support base 38 into and away from a position near the smelt spout. However, in some situations, the deck space in front of the smelt spouts is limited. Accordingly, an alternative embodiment is shown in FIGS. 25–30 for use in more limited space applications.

Figures 25, 26, 27, 28, 29, 30:
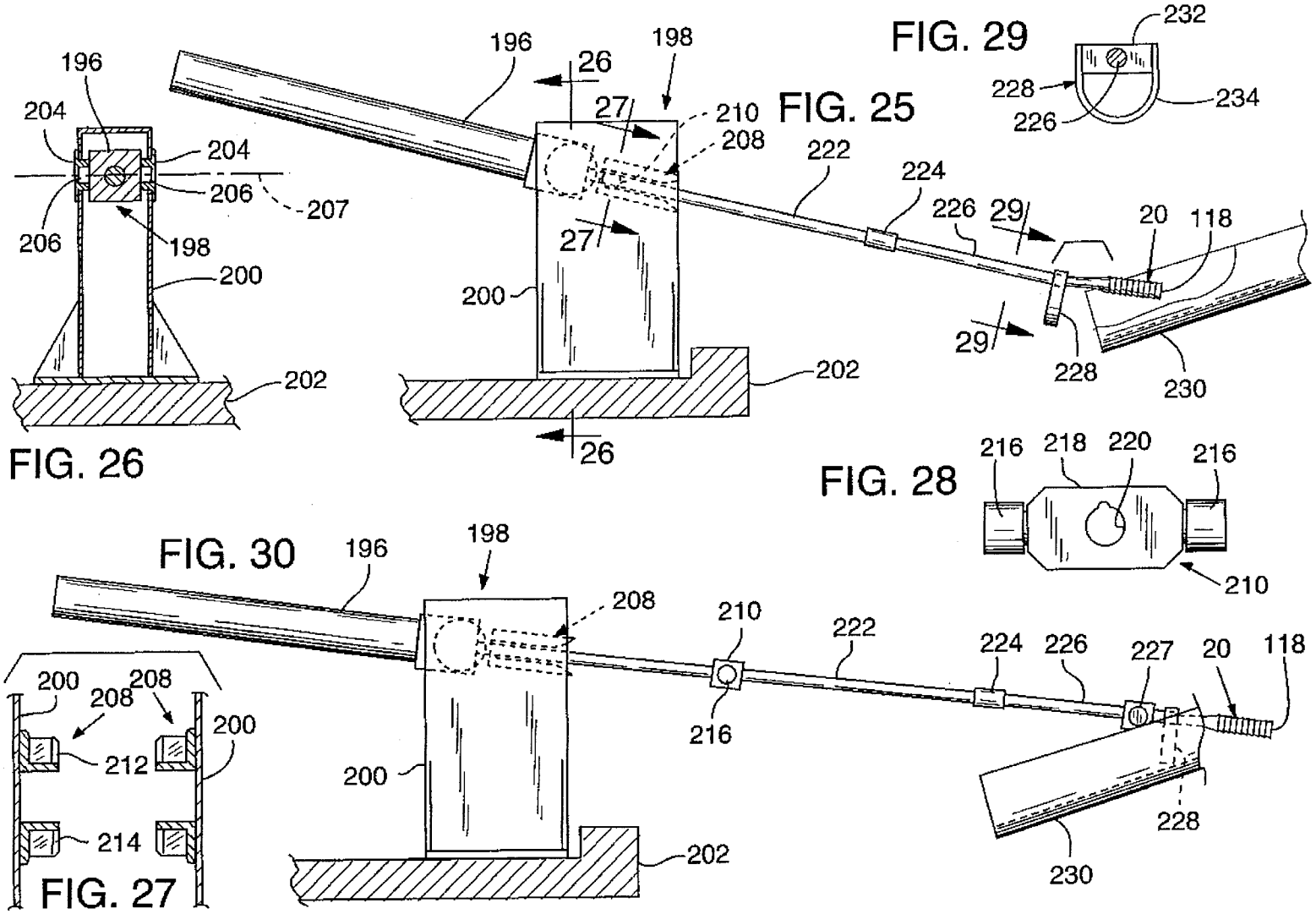
FIGS. 25, 26, 27, 28, 29 and 30 illustrate an alternative embodiment of a smelt spout cleaning apparatus employed when deck space is limited around the recovery furnace.

Referring to FIG. 25, a side view of the limited space smelt spout cleaner apparatus, the apparatus comprises an air cylinder or electric linear actuator 196 which is pivotally mounted via trunnion mount 198 to a base member 200 which provides support to maintain the various parts of the apparatus a desired spacing above deck floor 202. Referring to FIG. 26, which is a section view taken along lines A—A of FIG. 25, the trunnion mount is illustrated in greater detail. The mount consists of left and right journal bearing members 204 which receive journals 206 therewithin and enable pivotal movement of actuator 196 about the center axis 207 of the left and right journal bearing. Referring again to FIG. 25, a track portion 208 is mounted frontally of the linear actuator and receives a roller assembly 210 therewithin for allowing linear movement rearwardly and forwardly along the track. FIG. 27 is a cutaway view along line B—B of FIG. 25 illustrating the construction of the track which comprises left and right portions which mount to base member 200, each of left and right portions 210 comprising upper and lower guideways 212 and 214 respectively. As may be observed in FIG. 25, the frontal end of upper guide rails 212 flares upwardly, while the frontal end of lower guide rails 214 is flared downwardly. FIG. 28 illustrates roller 210 in greater detail wherein the roller comprises left and right roller wheels 216 which are maintained in spaced relation to each other via central web portion 218. The central web includes an aperture 220 in the center thereof. The two wheel portions 216 are rotationally mounted to the web portion 220 so as to allow free rotation of the wheels relative to the central web 218. The height of the two wheel portions 216 are suitably such that the wheels will roll between upper and lower guide rails 212 and 214. Referring again to FIG. 25, the actuator 196 is engaged with extension rod 222 which suitably passes through the aperture 220 in web portion 218. The roller assembly thereby provides support for the rod portion 222 while enabling translation along the axis of the rail portions 214 and 212. At the end of rod 222 distal from base member 200 is a mounting member 224 which enables attachments to be connected to rod 222. In the embodiment illustrated in FIG. 25, a scraper attachment 226 is connected to the rod and comprises a fixed scraper portion 228 at the end distal from connector 224. The scraper may also carry cleaning tip 20 thereon, for providing cleaning of the furnace opening. In FIG. 25, the smelt spout cleaner is illustrated with the actuator 196 in its retracted position whereby the scraper 228 is positioned away from the mouth of smelt spout 230. The spout cleaner is thereby held somewhat away from the noxious or potentially corrosive fumes emanating from the smelt when not in use.

Referring now to FIG. 30, a view of the smelt spout cleaner with the scraper in an extended position, it may be observed that as linear actuator 196 causes rod portion 222 to extend outwardly, roller assembly 210 rolls free of track portion 208 and accordingly, the actuator and scraper may pivot about the trunnion mount 198 to allow the scraper to move upwardly along the smelt spout. As the actuator is reversed so as to cause the extensible arm portion to retract, the scraper will traverse back downwardly along the smelt spout and roller assembly 210 will be received in the flared portions of the rails just as the scraper approaches the end of the smelt spout. Once the scraper is retracted away from and free of the smelt spout, the engagement between the rollers 216 and rails 212 and 214 will support the scraper arm to prevent it from falling towards the ground. The upward and downward flaring of rails 212 and 214 thereby enable the spout cleaner to be somewhat approximately positioned so that some vertical movement is allowed when the rollers 216 are re-engaging with guideways 212 and 214, reducing the need for extensive adjustment of the position of the spout cleaner for a particular individual spout installation.

The embodiment of FIGS. 25–30 is also suitably adapted to receive a heated attachment that corresponds to the attachment described hereinabove with respect to FIGS. 17–20. Support for the respective electrical connections would also be provided to ensure that the electrical supply cable to the heaters and thermostats would not become entangled during extension and retraction of the support arm.

FIG. 29 is a sectional view taken along line C—C of FIG. 25 and illustrates a particular configuration of scraper 228. Support rod 226 is received in a central web member 232 and the U-shaped scraper portion 234 receives the web member between the two respective arm portions of the U shape. It should be noted that the scraper illustrated in this embodiment is substantially open at the central portion thereof (i.e., U-shaped) rather than substantially solid as in the attachment 18 of FIG. 1. The attachment of FIG. 1 could also be employed with this embodiment. This embodiment maintains many of the advantages of the cleaning apparatus of FIG. 1, for example, ease of accessibility during operation, changeable attachment tips to accommodate varying cleaning needs and a linear cleaning stroke action along the extent of the smelt spout as opposed to the arcuate cleaning strokes of prior devices. Further, the angle of the smelt spout may be quite high relative to the actuator and depending on the bottom of the spout to guide the cleaning head may give rise to potential for piercing the wall of the spout and the cooling water pipes which surround the spout, which could result in a smelt water explosion. Accordingly, the cleaning head employed with the embodiment of FIGS. 25–30 may suitably be provided with rollers which are adapted to travel along the upper edges of the smelt spout so as to maintain the cleaning head a suitable distance above the bottom of the smelt spout so as to avoid the potential for puncturing the spout and cooling water pipes. The roller assembly 227 (illustrated in FIG. 30) is similar in configuration to roller assembly 210, having a central web portion engaging a rod portion of attachment 226 and the two rollers adapted to ride on the upper edges of the smelt spout, and is mounted rearwardly of scraper 228. In operation, the roller assembly engages the upper edge of the smelt spout and effectively keeps scraper 228 from contacting the smelt spout, to prevent smelt-water explosion as a result of accidental puncture of the spout and cooling pipes.

Figure 31:
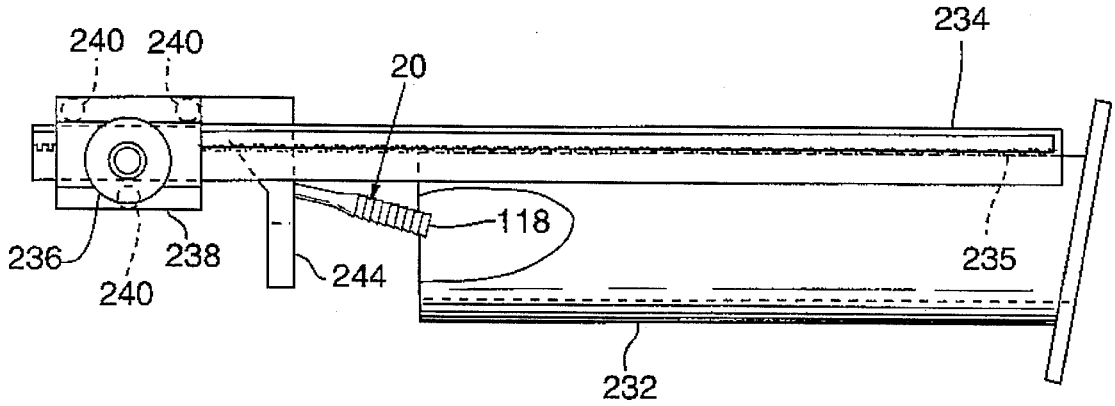
FIGS. 31 and 32 illustrate a spout-mounted smelt spout cleaning apparatus for use when no deck space is available around the boiler.
Figure 32:
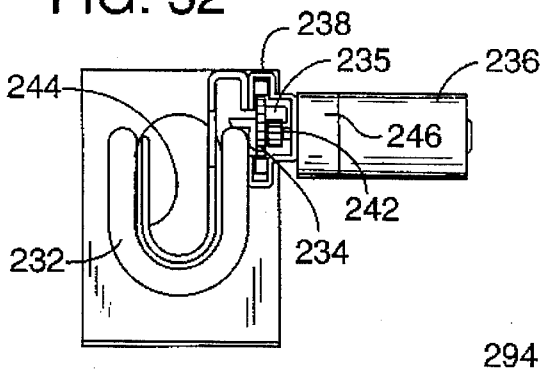

FIGS. 31 and 32 illustrate a further embodiment of a smelt spout cleaner adapted for use when virtually no deck space is available around the boiler. The embodiment of FIGS. 31 and 32 is advantageous in that it does not require a custom design for each particular boiler installation. The configuration and spacing of piping, catwalks, and other equipment around boilers is highly variable from installation to installation. Accordingly, the embodiment of FIGS. 31 and 32 may be employed and be unaffected by the unique catwalk and piping, etc. of the particular installation. However, the tradeoff is that the ability to employ interchangeable attachments and on-line removability is reduced.

In the embodiment of FIGS. 31 and 32, the unit is attached to the boiler smelt spout and traverses upwardly and downwardly along the spout. Referring to FIG. 31, a side view of the smelt spout cleaner as mounted to the spout, the smelt spout 232 receives a rack member 234 along one side wall thereof, with rack member 234 extending substantially the entire length of the spout and extending a distance beyond the end of the spout. The rack member 234 includes toothed rack portions thereon. A drive motor 236 is mounted to a carriage member 238 which includes upper and lower guide wheels 240 which ride on a portion of rack member 234. Motor 236 includes a toothed pinion gear 242 which engages with toothed rack portion 235 whereby when motor 236 is actuated, carriage portion 238 will traverse linearly along the extent of rack portion 234. A scraper arm portion 244 is securely attached to carriage 238 such that traversal of the carriage results in traversal of scraper portion 244 therewith. The scraper is of dimension and shape substantially conforming to the interior cross-sectional shape of the smelt spout 232 so as to scrape along the smelt spout and thereby affect cleaning as the carriage traverses along the extent of rack portion 234. Cleaning tip 20 is mounted forwardly of the cleaner so as to penetrate into and clean the furnace opening when the cleaning unit is at its forward limit of cleaning stroke along rack portion 234. The rack portion suitably extends a sufficient distance beyond the end of smelt spout 232 so as to enable the carriage and cleaning scraper to be moved away from the smelt when cleaning operations are not being performed. The apparatus thereby provides a smelt spout cleaner which is not excessively subjected to the corrosive effects of the hot smelt since the cleaner moves away from the area of the smelt when not in use. Motor 236 may comprise any suitable motor, for example an electric motor or an air powered motor. Gear reduction may be employed therewith so as to provide a suitable speed of traversal.

Figure 34:
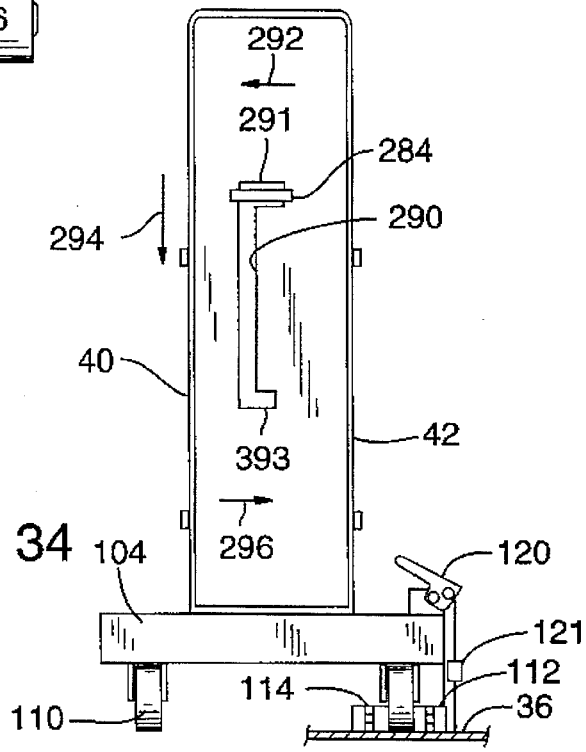
FIGS. 33 and 34 illustrate an alternate embodiment employing a mechanism for raising a portion of the cleaning apparatus for transport.
Figure 33:
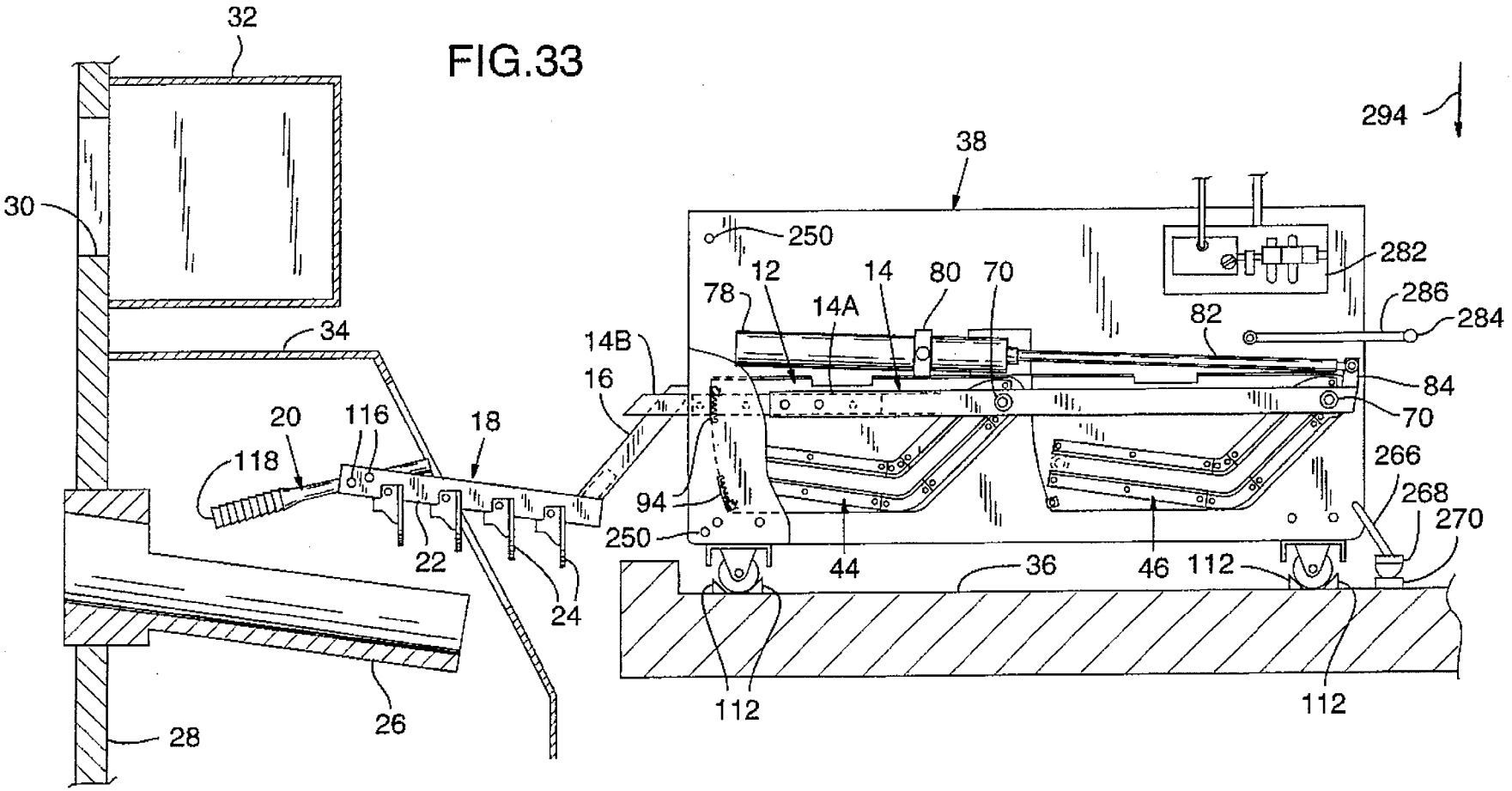

FIGS. 33 and 34 illustrate an alternative embodiment of the present invention employing a mechanism for raising a portion of the cleaning apparatus to enable transport. FIG. 33 is a side view of the apparatus while FIG. 34 is an end view. As may be observed in FIGS. 33 and 34, a handle 284 is attached to arm portion 286 which is pivotally mounted at pivot member 288 near the rear portion of the support base 38. The pivot member 288 supports the handle just above rod 82. It may be observed that the embodiment illustrated in FIG. 33 differs from that of FIG. 3 in that a lower portion of camming track 46 has been removed at the rearward most section thereof. Accordingly, when handle 284 is moved downwardly in the direction of arrow 294, arm 286 will pivot around pivot point 288 and press downwardly on rod 82 and/or rod eye 84, whereupon the actuator and forward portion of the spout cleaner will pivot upwardly, raising the cleaning head assembly up, ensuring that the assembly will not collide with or scrape along the deck, for example, as support base 38 is moved. Such potential for colliding with the deck becomes greater in installations where the smelt spout is at a level substantially below the level of the deck. FIG. 34 illustrates a slot 290 which is formed in a back wall of the apparatus wherein arm 286 extends through the slot leaving handle 284 exposed for access by an operator. The slot includes upper and lower keeper areas 291 and 293 which serve to lock the handle in its current position. In use, in order to raise the cleaning head assembly upwardly, an operator grasps handle 284 and moves it to the left slightly in the direction of arrow 292. Arm 286 is sufficiently flexible to allow the handle to move to the side while still providing return pressure such that the handle will return to the right once released. Having moved the handle to the left in the direction of arrow 292, the operator then moves handle 284 downwardly in the direction of arrow 294 which causes arm 286 to press down on rod 82 or rod eye 84 which causes the actuator and cleaning head assembly to pivot upwardly. The operator continues to move the handle downwardly until the handle reaches the bottom of slot 290 whereupon the operator moves the handle rightwardly in the direction of arrow 296. The operator then releases the handle which is kept in its lowered position by keeper portion 293 of slot 290. The apparatus may then be moved after releasing clamps 120. Once the apparatus is repositioned at a site for cleaning, the handle lowering operation may be reversed, wherein the handle is moved leftwardly, upwardly and then rightwardly, returning the cleaning apparatus to its lowered position.

While plural embodiments of the present invention have been shown and described, it will be apparent to those skilled in the art that many changes and modifications may be made without departing from the invention in its broader aspects. The appended claims are therefore intended to cover all such changes and modifications as fall within the true spirit and scope of the invention.

We claim:

1. Apparatus for automatically cleaning a smelt spout of a chemical recovery furnace, said apparatus comprising:

a cleaning head insertable into said smelt spout for movement there along to dislodge obstructions therefrom;

an elongated beam for carrying said cleaning head at a forward end thereof; and a support base for said beam located remotely along said beam from said cleaning head, said base supporting said beam and cleaning head;

said support base including means for longitudinally translating said beam in a path for moving said cleaning head toward said smelt spout and along a length of said smelt spout and for then retracting said cleaning head to a position rearwardly above said smelt spout, wherein said means for longitudinally translating said beam includes a camming track positioned on said support base, said beam including follower means engageable with said camming track, and an actuating means for selectively applying force to said beam in a direction longitudinal of said beam.

2. The apparatus according to claim 1 wherein said beam is elongated primarily in a horizontal direction and said base supports said beam and said cleaning head in cantilever fashion.

3. The apparatus according to claim 1 wherein said smelt spout is disposed at an angle to the horizontal whereby smelt can be poured therefrom, and wherein said means for longitudinally translating said beam comprises means for guiding said cleaning head substantially parallel to said smelt spout along at least a portion of the length of said smelt spout.

4. The apparatus according to claim 1 wherein said camming track comprises:

a first portion disposed in substantially parallel relation to said smelt spout for enabling said cleaning head to move along said smelt spout substantially parallel thereto; and a second portion angularly related to said first portion for enabling said cleaning head to upraise from said smelt spout to a retracted position.

5. The apparatus according to claim 4 including a support for adjustably mounting said camming track at different angles.

6. The apparatus according to claim 5 wherein said support for adjustably mounting said camming track comprises an angularly movable plate on said support base and carrying said track, said support base having multiple aperture positions for receiving fastening means securing said plate.

7. The apparatus according to claim 1 wherein said support base is provided with wheels for enabling movement of said apparatus and selective placement of said beam and cleaning head in alignment with said smelt spout.

8. Apparatus for automatically cleaning a smelt spout of a chemical recovery furnace, said apparatus comprising:

a cleaning head insertable into said smelt spout for movement there along to dislodge obstructions therefrom;

an elongated beam for carrying said cleaning head at a forward end thereof; and a support base for said beam located remotely along said beam from said cleaning head, said base supporting said beam and cleaning head;

said support base including means for longitudinally translating said beam in a path for moving said cleaning head toward said smelt spout and along a length of said smelt spout and for then retracting said cleaning head to a position rearwardly above said smelt spout, wherein said cleaning head further comprises a heating means for heating at least a portion of said cleaning head for assisting in melting of smelt in the smelt spout.

9. The apparatus according to claim 1 wherein said cleaning head comprises auger means for boring through obstructions.

10. The apparatus according to claim 1 wherein a portion of said cleaning head is shaped to a profile of at least a portion of the smelt spout.

11. The apparatus according to claim 1 further comprising locking means for anchoring said support base against movement.

12. The apparatus according to claim 1 further comprising means for determining alignment of said apparatus relative to the smelt spout.

13. The apparatus according to claim 1 further comprising means for determining whether said support base is properly positioned at an operating position.

14. The apparatus according to claim 1 further comprising means for sensing movement of the furnace relative to the apparatus.

15. The apparatus according to claim 1 wherein said cleaning head comprises a tip member adapted for insertion into an opening between the smelt spout and the chemical recovery furnace.

16. The apparatus according to claim 1 further comprising a camera mounted to provide a view of the smelt spout for enabling remote viewing of the operation of the apparatus.

17. The apparatus according to claim 1 wherein said means for longitudinally translating comprises a cylinder actuator mounted to move said cleaning head toward said smelt spout on a retraction stroke of said cylinder actuator and to retract said cleaning head on an extension stroke of said cylinder actuator.

18. Apparatus for automatically cleaning a smelt spout of a chemical recovery furnace wherein said smelt spout is disposed at an angle to the horizontal whereby smelt can be poured therefrom, said apparatus comprising:

a cleaning head insertable into said smelt spout for movement there along to dislodge obstructions therefrom; and means for longitudinally translating said cleaning head toward and along a length of said smelt spout and for then retracting said cleaning head, said means for longitudinally translating said cleaning head comprising guide means, follower means engageable with said guide means, and actuating means for selectively applying force to said follower means for moving said cleaning head along said smelt spout, wherein said guide means has a first portion disposed in substantially parallel relation to said smelt spout for enabling said cleaning head to move linearly along said smelt spout, wherein said guide means has a second portion angularly related to said first portion for enabling said cleaning head to upraise from said smelt spout to a retracted position.

19. The apparatus according to claim 18 including a support for adjustably mounting said guide means at different angles.

20. The apparatus according to claim 18 wherein said first portion of said guide means comprises an upper edge of the smelt spout.

21. The apparatus according to claim 20 wherein said follower means comprises rollers adapted to travel along the upper edge of said smelt spout.

22. Apparatus for automatically cleaning a smelt spout of a chemical recovery furnace wherein said smelt spout is disposed at an angle to the horizontal whereby smelt can be poured therefrom, said apparatus comprising:

a cleaning head insertable into said smelt spout for movement there along to dislodge obstructions therefrom; and means for longitudinally translating said cleaning head toward and along a length of said smelt spout and for then retracting said cleaning head, said means for longitudinally translating said cleaning head including guide means, follower means engageable with said guide means, and actuating means for selectively applying force to said follower means for moving said cleaning head along said smelt spout, wherein said cleaning head comprises a heating means for heating at least a portion of said cleaning head for assisting in melting of smelt in the smelt spout.

23. The apparatus according to claim 18 wherein said cleaning head comprises auger means for boring through obstructions.

24. The apparatus according to claim 18 further comprising means for sensing movement of the furnace relative to the apparatus.

25. The apparatus according to claim 18 wherein said guide means and said follower means maintain said cleaning head away from the smelt spout when in a retracted position for reducing exposure of said cleaning head to corrosive fumes from the smelt when said apparatus is not in a cleaning mode.

26. Apparatus for automatically cleaning a smelt spout of a chemical recovery furnace, said apparatus comprising:

a cleaning head insertable into said smelt spout for movement therealong to dislodge obstructions therefrom;

a drive motor carrying said cleaning head therebelow;

a support beam extending along a portion above said smelt spout and extending a distance beyond the pouring end of said smelt spout, for supporting said drive motor and cleaning head, whereby cleaning of said smelt spout is effected by said drive motor moving said drive motor and said cleaning head along a length of said support beam, thereby moving said cleaning head along the portion of said smelt spout.

27. The apparatus according to claim 1 wherein said support base includes an opening through which said beam extends, further comprising a screen member for shielding the opening from entry of an object therethrough, while still enabling vertical and longitudinal translation of said support beam.

28. The apparatus according to claim 1 further comprising means for intermittently actuating said actuating means on a regular or random basis.

29. The apparatus according to claim 1 further comprising a target and a sensor means, said target mounted on one of the chemical recovery furnace or the apparatus and said sensor means mounted on the other of said apparatus or chemical recovery furnace, for sensing movement of the furnace as a result of thermal expansion or the like for warning of potential misalignment of said apparatus relative to the furnace.

30. The apparatus according to claim 1 further comprising means for detecting whether said apparatus is appropriately positioned at an operating position relative to the chemical recovery furnace.

31. The apparatus according to claim 1 further comprising means for raising said cleaning head to a non-operating position.

32. The apparatus according to claim 1 further comprising:

a securement member for securing said cleaning head to said elongated beam, said securement member comprising a first portion having a channel therein for receiving a portion of a cleaning head assembly therein; and a second portion for fixing said cleaning head portion in said channel.

33. An apparatus for cleaning a spout of a chemical recovery furnace, comprising:

an extensible cleaning arm;

a base portion pivotally supporting said cleaning arm; and drive means for extending and retracting said extensible cleaning arm, wherein said base portion further comprises a guide means and a follower means, wherein said guide means includes a flared portion such that, during extension, said follower means leaves said guide means and upon retraction, said follower means re-enters said guide means at said flared portion thereof.

34. The apparatus according to claim 33 further comprising a guide portion mounted to said cleaning arm wherein said guide portion rides along a portion of the spout of the chemical recovery furnace for guiding said cleaning head therealong.

35. The apparatus according to claim 33 further comprising interchange means for allowing selective attachment of various cleaning heads for attachment to said cleaning arm.

36. The apparatus according to claim 1 further comprising interchange means for allowing selective attachment of various cleaning heads for attachment to said cleaning arm.

* * * * *